US005172938A

United States Patent [19]

Schmidt

[11] Patent Number: 5,172,938

[45] Date of Patent: Dec. 22, 1992

[54] I.D. CARD PRODUCT

[75] Inventor: Eric Schmidt, Elgin, Ill.

[73] Assignee: Wallace Computer Services, Inc., Hillside, Ill.

[21] Appl. No.: 615,309

[22] Filed: Nov. 19, 1990

Related U.S. Application Data

[63] Continuation-in-part of Ser. No. 415,877, Oct. 2, 1989, Pat. No. 4,982,894.

[51] Int. Cl.[5] ..... B42D 15/00

[52] U.S. Cl. ..... 283/109; 283/75; 283/94; 283/105; 283/107; 283/108

[58] Field of Search ..... 283/107, 108, 109, 74, 283/75, 100, 101, 105, 94

[56] References Cited

U.S. PATENT DOCUMENTS 4,204,706 5/1980 Blum et al. ..... 283/109
4,982,894 1/1991 Schmidt ..... 283/75

FOREIGN PATENT DOCUMENTS 222424 5/1987 European Pat. Off. ..... 283/101

*Primary Examiner*—P. W. Echols
*Assistant Examiner*—David P. Bryant
*Attorney, Agent, or Firm*—Tilton, Fallon, Lungmus & Chestnut

[57] ABSTRACT

An I.D. product wherein a ply having longitudinal and transverse lines of perforation defines an I.D. card, a pressure sensitive-equipped transparent film having a first portion attached to the ply and a second portion of the film being positioned in face-to-face relation to the ply, the second portion of the film being equipped with a release liner.

10 Claims, 3 Drawing Sheets

Fig. 1
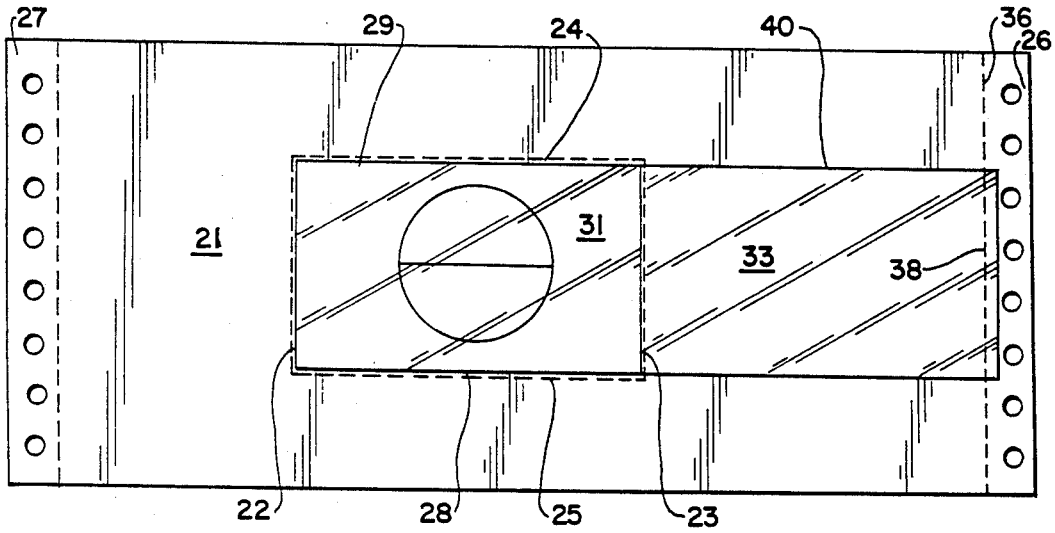
Fig. 2
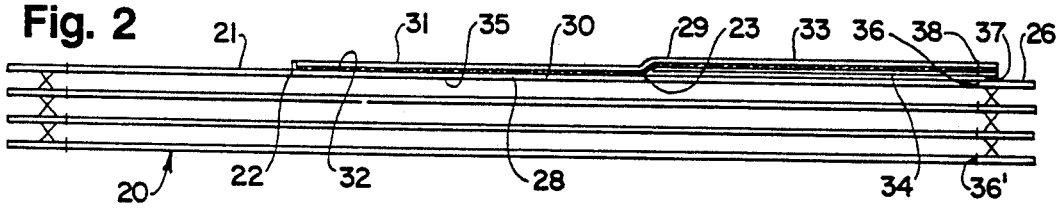
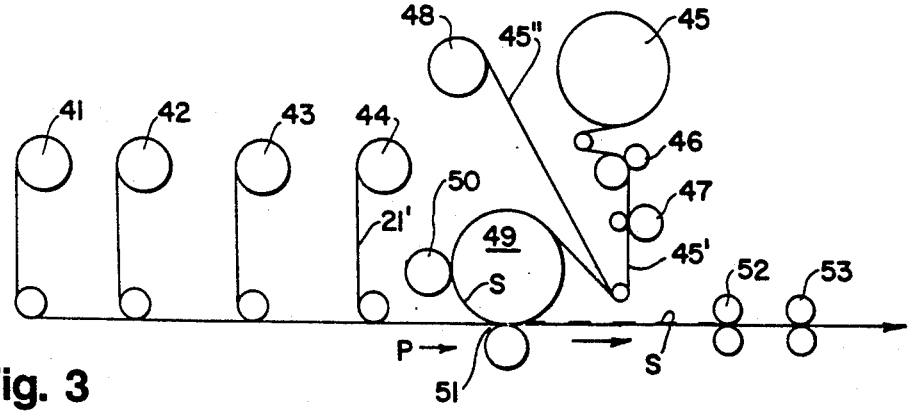
Fig. 3

Fig. 4
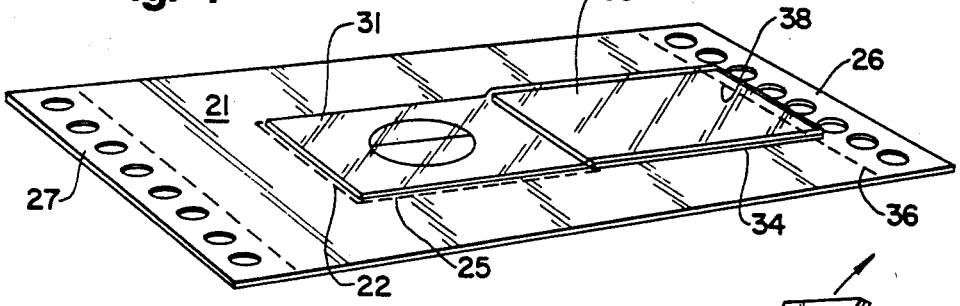
Fig. 5
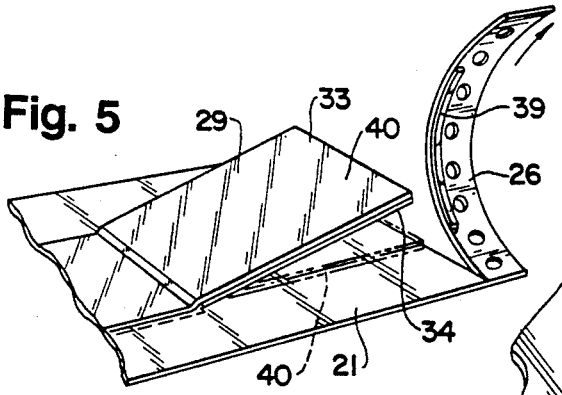
Fig. 6
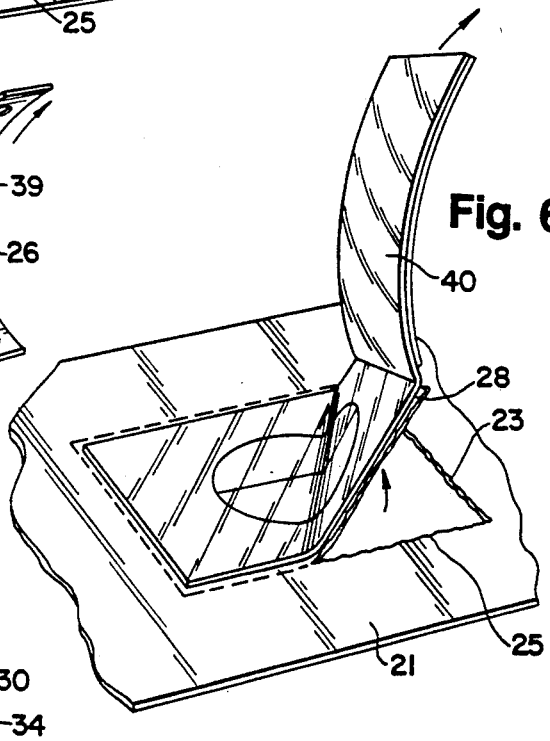
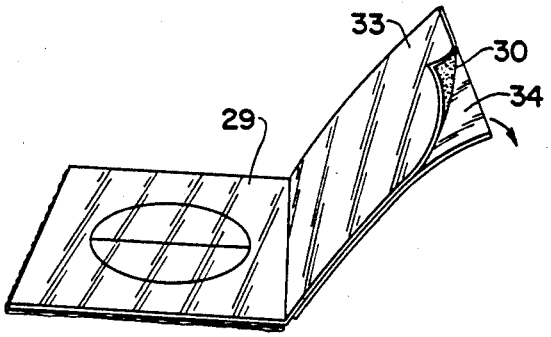
Fig. 7
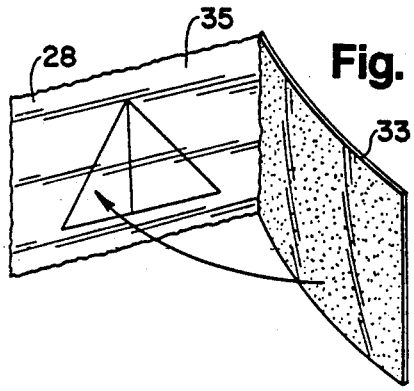
Fig. 8

Fig. 9
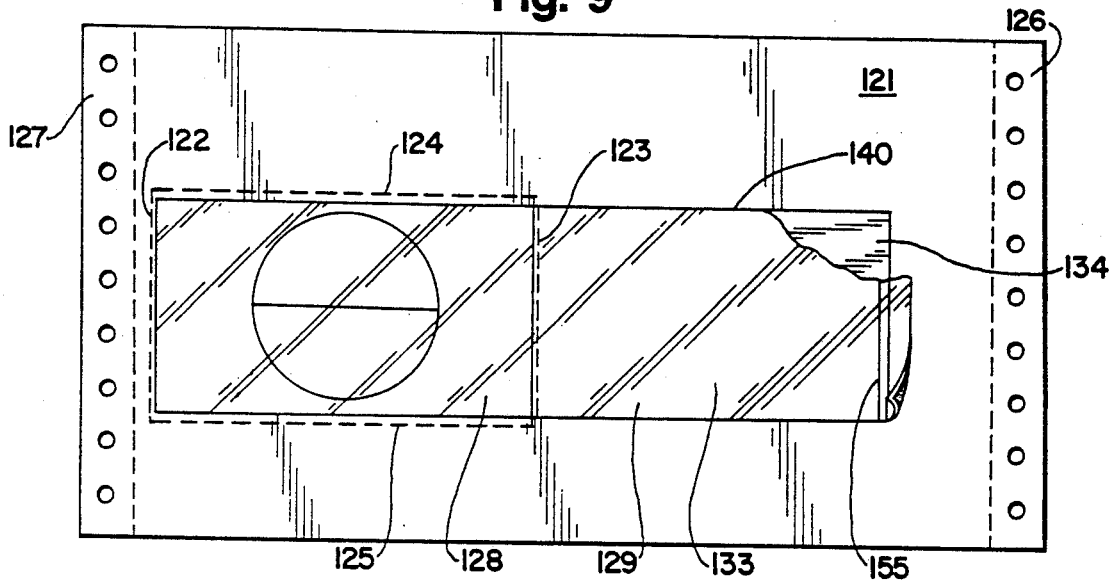
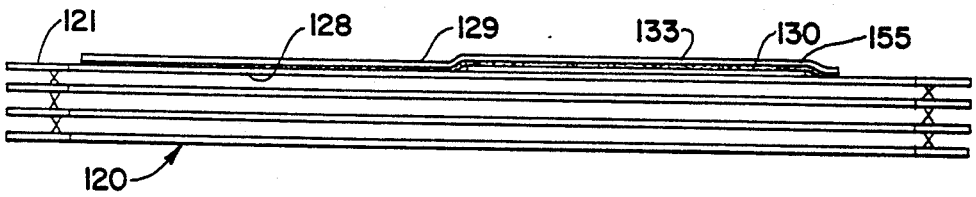
Fig. 10
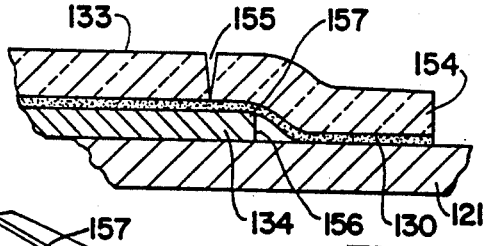
Fig. 11
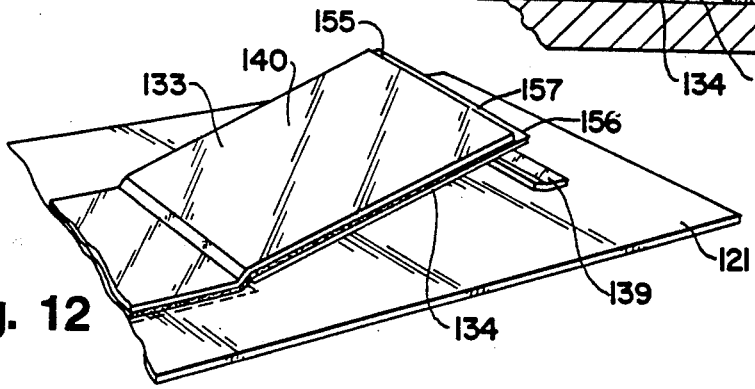
Fig. 12

I.D. CARD PRODUCT

This application is a continuation-in-part of my co-pending application Ser. No. 415,877 filed Oct. 2, 1989, now U.S. Pat. No. 4,982,894.

BACKGROUND AND SUMMARY OF INVENTION

This invention relates to an I.D. card product and, more particularly, to an I.D. card which incorporates laminating means for the user to cover the card after the same has been signed.

In my co-pending application Ser. No. 415,877 filed Oct. 2, 1989, Now U.S. Pat. No. 4,982,894, a mailer incorporating an I.D. card was disclosed. I now find that the I.D. card construction can be provided advantageously as part of a single ply, either separate or part of a connected series—or as one ply of a multi-ply unit set.

According to the invention, a ply carries an integral, separable I.D. card. Provided with the ply is a pressure sensitive adhesive-equipped transparent film having a first portion attached to the ply which is advantageously made of card stock and a second portion of the film is arranged in face-to-face relation with the card stock. The second portion of the film is equipped with a release liner over the pressure sensitive adhesive whereby upon removal of the release liner, the film is movable into covering relation with the I.D. card.

Other objects and advantages of the invention may be seen in the details of construction and manufacture set forth in the ensuing specification.

BRIEF DESCRIPTION OF DRAWING

The invention is described in conjunction with the accompanying drawing, in which FIG. 1 is a top plan view of a product made according to the invention;

FIG. 2 is a side view of the product of FIG. 1 featured as part of a unit set;

FIG. 3 is a schematic side elevational view of apparatus employed in the method of the invention;

FIG. 4 is a perspective view of the ply of FIG. 1; and

FIGS. 5-8 are perspective views showing the steps of developing the individual I.D. card;

FIG. 9 is a top plan view of a modified embodiment of the invention;

FIG. 10 is a side elevational view of the product of FIG. 9 featured as part of a unit set;

FIG. 11 is an enlarged fragmentary sectional view as would be seen along the sight line 11—11 applied to FIG. 9; and FIG. 12 is a fragmentary perspective view showing the step of removing the I.D. card from the ply providing the same.

DETAILED DESCRIPTION

Referring first to FIG. 2, the numeral 20 designates generally a unit set, viz., a stack of plies or forms which can carry any desired information indicia. The uppermost ply 21 (as illustrated) is the ply which provides the I.D. card. The important ply insofar as the I.D. card is concerned is the ply 21 which is advantageously constructed of card stock, being somewhat stiffer than the remaining plies. For example, one or more of the lower plies may be an information ply advising the ultimate recipient on the conditions of use of the I.D. card.

The I.D. card is defined as part of the ply 21 by longitudinal and transverse lines of weakness such as slits or lines of perforation 22, 23 and 24, 25—see FIG. 1. The term "longitudinal" is used in the sense of the movement of a continuous web during manufacture which will be described hereinafter relative to FIG. 3. This movement is facilitated through the use of control punch margins 26, 27 which extend longitudinally of the web or webs being processed and which are removed prior to sale or use. Ultimately, the I.D. card 28 defined by perforation lines 22-25 is separable from the remainder of ply 21 by breaking the perforation bonds.

Still referring to FIGS. 1 and 2, the numeral 29 designates a transparent film which, on its lower face, is equipped with pressure sensitive adhesive as at 30. This insures that one portion 31 of the film 29 is in covering relationship to one face 32 of the I.D. card 28—the upper face as shown. The remaining portion 33 of the film 29 has its pressure sensitive adhesive covered by a release liner 34 which advantageously is constructed of silicone paper.

In use, the I.D. card 28 is detached from the ply 21. Thereafter, the release liner 34 is removed from the film portion 33 and the portion 33 is rotated through 180° to come into covering relation with the lower face 35 of the I.D. card 28—this after the lower face has been signed by the user.

DETAILED OPERATION

In one illustrated embodiment of the invention, I secure the second or remaining portion 33 of the film 29 to an adjacent control punch margin—see the right hand portion at 26 in FIGS. 1, 2 and 4. It will be appreciated that the control punch margin 26 is defined along the longitudinal side edge of the ply 21 by a line of perforation 36 which also is duplicated in the other plies as at 36' (see FIG. 2). For the purpose of securing the second portion 33 of the transparent film 29, I apply a line of adhesive 37 (see the right hand portion of FIG. 2) to the release liner 34. Because of the cohesion of the release liner 34 to the portion 33 by virtue of the pressure sensitive adhesive 30, the second portion 33 is firmly attached to the control punch margin 26 through the medium of the adhesive 37 securing the release liner 34 to the margin 26. For ease of detachment and use, I provide a line of potential severance, i.e., perforation 38 through the second portion 33 and release liner 34 which is aligned with the line of perforation 36 defining the control punch margin 26.

Referring now to FIG. 5, the control punch margin 26 is shown in the process of being detached from the remainder of the ply 21. As it is removed, it carries with it a minor portion 39 of the combined second portion 33 of the transparent film 29 and the release liner 34. This permits the combined second portion 33 and release liner 34 to be grasped and moved upwardly by pivoting from the dotted line position designated 40' to the solid line position designated 40 in FIG. 5.

Now referring to FIG. 6, continued upward pulling on the combined member 40 results in full detachment of the I.D. card 28 from the remainder of ply 21 via separation along the lines of perforation as illustrated at 23 and 25 in FIG. 6. At this point in time, the underside 35 of the I.D. card 28 can be signed by the user.

Now referring to FIG. 7, the release liner 34 underlying the second section 33 is being peeled away to expose the portion of the pressure sensitive adhesive 30 underlying the second portion 33 of the transparent film 29.

Finally, as seen in FIG. 8, the second section 33 is move into covering relation with the lower face 35 of the I.D. card 28.

METHOD OF MANUFACTURE

Reference is now made to FIG. 3 wherein the numerals 41–44 at the left hand portion designate rolls of continuous web material providing the plies illustrated in FIG. 2. The roll 44 is constructed of card stock material and provides the ply 21. In FIG. 3, the ply material 21' is unwound and advanced along a longitudinally extending path as at P where laminate segments S are applied thereto in longitudinally, spaced relation. The segments S include the film 29, pressure sensitive adhesive 30 and release liner 34.

To provide these in proper position, I start with a roll of laminate as at 45—see the central portion of FIG. 3. This has the three elements superposed, viz., the film 29, the pressure sensitive adhesive 30 and completely overlying the pressure sensitive adhesive 30 is liner material ultimately providing the liner 34. This laminate 45' is unwound from the roll 45 by means of pull rolls 46 and advanced through a slitter assembly 47 which divides the liner into the portion remaining and the portion which is unneeded. The unneeded liner—in the illustration given in FIGS. 1 and 2 constituting one-half of the liner material—is removed as at 45" for rewinding as at 48 for ultimate disposal.

The remaining laminate is advanced onto the surface of a vacuum roll or drum 49 which rotates at a speed faster than the travel of the web laminate 45'. Thus, there is slippage but still retention of the web 45' on the surface of the vacuum roll 49.

The web is transversely severed by means of a knife roll 50 into the discrete segments S and since these segments are no longer restrained by being connected to the main web, they travel with the faster rotating vacuum roll 49 and, in effect, are accelerated to provide a spacing between adjacent segments.

The superposed webs from rolls 41–44 enter a nip 51 where segments S are applied in longitudinally spaced relation. Thereafter perforators or slitters 52 and 53 are employed to provide the longitudinal and transverse lines of weakness 22–25 as well as the longitudinally extending lines of perforation defining the control punch margins 26, 27 and, where the ply 21 is part of a connected string, transverse lines of perforation separating the web 21' into a series of detachable plies 21 and also the other plies to provide the unit sets 20.

The invention also contemplates providing the ply 21 as an intermediate ply in which case an overlying ply can be employed to hold down the combined elements 40 without the need for adhesive securement to an adjacent control punch margin. Still further, even where the ply 21 is the uppermost ply—or a single ply in itself—the pressure exerted by the nip 51 can insure that this flap-like combined element 40 remains essentially coplanar with the ply 21.

In some instances, it is advantageous to use the I.D. card product of FIGS. 9–12. This differs essentially from the previously described embodiment in the manner in which the liner-equipped flap (40 in the previous embodiment—see FIG. 5) is attached to the card stock ply. For ease of understanding, the elements of the FIGS. 9–12 embodiment are designated with like numerals but increased by 100.

In FIG. 10, for example, the unit set is designated by the numeral 120 and the card stock ply designated 121.

As seen in FIG. 9, the ply 121 is equipped with control punch margins as at 126 and 127. As pointed out previously, there is a difference between the embodiment of FIG. 9 from that of FIG. 1 in the location of the combined elements constituting the flaps 40 and 140. In FIG. 1, the flap 40 was secured to the control punch margin 26 whereas in FIG. 9, the combined-element flap 140 is secured to the main body of the ply 121 inboard of the control punch margin 126.

For this purpose, the second portion 133 of the transparent film 129 is extended transversely beyond the release liner 134 as at 154 in FIG. 11. Thus, there is a side edge part of the second portion 133 which overlaps the release liner 134—and since the second portion 133 is equipped on its confronting face with pressure sensitive adhesive 130, a means for securing the part 154 to the ply 121 is conveniently present.

To effect removal of the I.D. card from the remainder of the ply 121, I provide a slit 155 in the transparent film 133 slightly inboard of the adjacent edge 156 of the release liner 134.

Thus, when a fingernail is inserted under the release liner 134, the flap 140 can be lifted upwardly as shown in FIG. 12 and thereby obtain the same configuration as is shown in FIG. 5 relative to the first-described embodiment. This results in a small strip 139 (see FIG. 12) remaining on the ply 121 much the same as the remnant strip 39 remains with the control punch margin 26 in FIG. 5.

The same result is obtained if the user breaks the lines of weakness 122–125 (see FIG. 9) so as to remove the I.D. card 128 first from the ply 121. In FIG. 9, I show the lines of weakness 122, 123 as slits with the lines of weakness 124, 125 being lines of perforation. This, or the alternative—122, 123 being perforations and 124, 125 being slits, aids in the removal of the card.

In either event, there is provided an "underlap" as at 157 which facilitates separation of the release liner 134 from the second portion 133 of the transparent film 129.

While in the foregoing specification a detailed description of the invention has been set down for the purpose of illustration, many variations in the details hereingiven may be made by those skilled in the art without departing from the spirit and scope of the invention.

I claim:

1. An I.D. product comprising a generally rectangular ply having a front, a rear and a pair of longitudinally-extending side edges, said ply including card stock having intersecting longitudinal and transverse lines of weakness defining an I.D. card, a pressure sensitive adhesive-equipped transparent film having first and second portions, said first portion being attached to one face of said I.D. card, said second portion of said film being in face-to-face relation with said ply, said second portion of said film being equipped with a release liner in covering relation to said pressure sensitive adhesive and interposed between said film and said ply and said film second portion being movable into covering relation with the other face of said I.D. card, said film second portion and release liner having longitudinally extending side edges constituting an attachment part, a longitudinally extending line of potential severance in said attachment part spaced slightly inward of the longitudinally extending side edge of said film second portion, and adhesive means securing said attachment part to said ply whereby said attachment part remains with said ply upon severing along said line of potential severance.

2. The I.D. product of claim 1 in which the longitudinally extending side edge of said film second portion overlaps said release liner side edge whereby said pressure sensitive adhesive secures said attachment part to said ply.

3. The I.D. product of claim 2 in which said line of potential severance is spaced slightly inward of the longitudinally extending side edge of said release liner.

4. The I.D. product of claim 1 in which said longitudinally extending side edges of said film second portion and said release liner are aligned, said line of potential severance is in both said film second portion and said release liner, and further adhesive means secures said release liner to the portion of said ply aligned with said attachment part.

5. The I.D. product of claim 4 in which said ply is equipped along one of its longitudinally extending side edges with a control punch margin defined by a longitudinally extending line of perforation adjacent said one longitudinally extending side edge of said ply, said line of potential severance being aligned with said longitudinally extending line of perforation whereby detachment of said control punch margin simultaneously separates said attachment part from the remainder of said film second portion and said release liner.

6. An I.D. card product comprising a generally rectangular ply having a front, a rear and a pair of side edges, at least one of said side edges being equipped with a longitudinally extending control margin defined by a line of perforation extending parallel to said one side edge and spaced therefrom, said ply including card stock having intersecting longitudinal and transverse lines of weakness therein defining and I.D. card having first and second faces, pressures sensitive adhesive-equipped transparent film having first and second portions, said first portion being attached to said first face of said I.D. card, the second portion of said film being in face-to-face relation with said ply, said second portion of said film being equipped with a release liner covering said pressure sensitive adhesive and interposed between said film and said ply and said film second portion being movable into covering relation with said second face of said I.D. card, said film second portion and said release liner being adhesively attached to said control margin, with a line of perforation in said film second portion and said release liner aligned with the line of perforation in said ply whereby upon detachment of said control margin said second portion is available for removal of said release liner and pivoting into said covering relation.

7. An I.D. card product comprising a generally rectangular ply having a front, a rear and a pair of longitudinally-extending side edges, at least one of said side edges being equipped with a longitudinally extending control margin defined by a line of perforation extending parallel to said one side edge and spaced therefrom, said ply including card stock having intersecting longitudinal and transverse lines of weakness therein defining an I.D. card, pressure sensitive adhesive equipped transparent film having first and second portions, said first portion being attached to one face of said I.D. card, the second portion of said film being in face-to-face relation with said ply, said second portion of said film being equipped with a release liner in covering relation to said pressure sensitive adhesive and interposed between said film and said ply, said film second portion and release liner having longitudinally extending side edges adjacent said control punch margin, said film second portion having an attachment part adjacent the longitudinally extending side edge thereof secured to said ply, said attachment part being defined by a line of potential severance spaced inward of the longitudinally extending side edge of said film second portion.

8. The I.D. card product of claim 7 in which said side edges of said film second portion and said release liner are aligned, and adhesive means on said release liner secures said attachment part to said ply.

9. The I.D. card product of claim 7 in which the longitudinally extending side edge of said film second portion overlaps the longitudinally extending side edge of said release liner whereby said pressure sensitive adhesive adjacent the longitudinally extending side edge of said film second portion secures said attachment part to said ply.

10. The I.D. card product of claim 7 in which said line of potential severance is aligned with said line of perforation.

* * * * *